US007283102B2

(12) United States Patent
Miles

(10) Patent No.: US 7,283,102 B2
(45) Date of Patent: Oct. 16, 2007

(54) RADIAL CONSTRAINED LENS

(75) Inventor: Thomas Miles, St. Petersburg, FL (US)

(73) Assignee: Science Applications International Corporation, San Diego, CA (US)

( * ) Notice: Subject to any disclaimer, the term of this patent is extended or adjusted under 35 U.S.C. 154(b) by 0 days.

(21) Appl. No.: 11/325,321

(22) Filed: Jan. 5, 2006

(65) Prior Publication Data

US 2006/0119527 A1 Jun. 8, 2006

Related U.S. Application Data

(62) Division of application No. 10/852,515, filed on May 24, 2004, now Pat. No. 7,081,858.

(51) Int. Cl.
*H01Q 19/06* (2006.01)

(52) U.S. Cl. ..... 343/754; 343/705; 343/753; 343/785; 343/850

(58) Field of Classification Search ..... None
See application file for complete search history.

(56) References Cited

U.S. PATENT DOCUMENTS 3,022,506 A * 2/1962 Goebels, Jr. et al. ..... 343/771
4,507,662 A 3/1985 Rothenberg et al.
4,931,808 A * 6/1990 Lalezari et al. ..... 343/753

* cited by examiner

*Primary Examiner*—Tho Phan
*Assistant Examiner*—Chuc Tran
(74) *Attorney, Agent, or Firm*—Banner & Witcoff, Ltd.

(57) ABSTRACT

The invention provides apparatuses for a radial constrained lens in a steerable directional antenna system. The radial constrained lens includes a feed array that excites a continuous radiating aperture through a section of radial waveguide. Feed elements of the feed array are coupled to a feed network that processes a signal for each of the active feed elements. A feed array may include a plurality of feed probes or a plurality of waveguide sections. A sector, which includes a contiguous subset of feed elements, may be configured by a switching arrangement either in a transmit mode or a receive mode. The radial constrained lens may be commutated about a full 360 degree aperture view. Also, a plurality of radial constrained lens may be vertically stacked so that a scanned beam may be adjusted both in an azimuth and elevation directions.

10 Claims, 6 Drawing Sheets

200
TOP
SSNMA LENS
201
209
215
211
217
207
SPACER
SSNMA LENS
213
FOAM SPACER
SSNMA LENS
205
BOTTOM
SSNMA LENS
203
219

381(D1)
383(D2)
385(D3)
313
315
303
309
311
351
(Del)
301a
301b
307
305
387(D4)

400
409
411
403
401b
453
451
401a
407
405

75/

MEASURED RCL AZIMUTH ANTENNA PATTERN (LAB)

RADIAL CONSTRAINED LENS

This application is a divisional application of and claims priority to U.S. patent application Ser. No. 10/852,515, U.S. Pat. No. 7,081,858, filed May 24, 2004 which is hereby incorporated in its entirety.

FIELD OF THE INVENTION

The present invention relates to an antenna system having a cylindrical or conical aperture. In particular, the invention includes a feed mechanism that reduces the number of required feed elements.

BACKGROUND OF THE INVENTION

Steerable directional antennas are utilized in numerous applications for communications with the number of applications increasing with new services and needs. For example, steerable directional antennas play a major role in military applications that include synthetic aperture radar systems and phased array communication systems. Also, steerable directional antennas are being increasingly deployed in the commercial arena. As an example, the wireless local area network (WLAN) market is migrating to higher frequency spectra, higher data rates, and higher user densities so that multipath fading and multichannel interference are becoming even more crucial issues. Consequently, the wireless industry is investigating phased array antennas with adaptive control to enhance the data capacity of wireless local area networks.

To illustrate the current technology, a WLAN antenna has been developed for 19 GHz operation by Nippon Telegraph and Telephone Corporation. The antenna is basically a cylindrical twelve-sector antenna that incorporates a complex switching matrix and uses a costly multilayer circuit board fabrication technique to implement the cylindrical phased array. Steerable directional antennas are also being deployed as "smart" antennas, which are phased array antennas with adaptive control. Smart antennas often utilize parallel analog and DSP (digital signal processor) signal processing that tends to be computationally intensive, in which processing complexity increases exponentially with the number of antenna and feed elements.

Consequently, the military and commercial markets have a real need for apparatuses that support steerable directional antennas having desired performance characteristics but that are more cost effective and easier to implement. Relevant design considerations include weight, scan coverage, and the complexity of circuitry that interfaces with the steerable directional antenna.

BRIEF SUMMARY OF THE INVENTION

The invention provides apparatuses for a radial constrained lens and for the incorporation of the radial constrained lens in a steerable directional antenna system. The radial constrained lens includes a feed array that excites a continuous radiating aperture through a section of radial waveguide. Feed elements of the feed array are coupled to a feed network that processes an excitation signal for each of the active feed elements.

According to an aspect of the invention, a feed array includes a plurality of feed probes that are located approximately one quarter wavelength in front of a circular wall or disk that functions as ground plane. Alternatively, the feed array may consist of a plurality of feed waveguide sections which are coupled to mating holes through a disk.

According to another aspect of the invention, a sector, which includes a contiguous subset of feed elements, may be configured by a switching arrangement. A radial constrained lens may be commutated about a full aperture view, i.e., a 360-degree azimuth angle.

With another aspect of the invention, a radial constrained lens may be configured for either a transmit mode or a receive mode.

According to another aspect of the invention, a plurality of radial constrained lens may be vertically stacked so that a scanned beam may be adjusted both in azimuth and elevation directions.

BRIEF DESCRIPTION OF THE DRAWINGS

A more complete understanding of the present invention and the advantages thereof may be acquired by referring to the following description in consideration of the accompanying drawings, in which like reference numbers indicate like features and wherein.

DETAILED DESCRIPTION OF THE INVENTION

Figure 1:
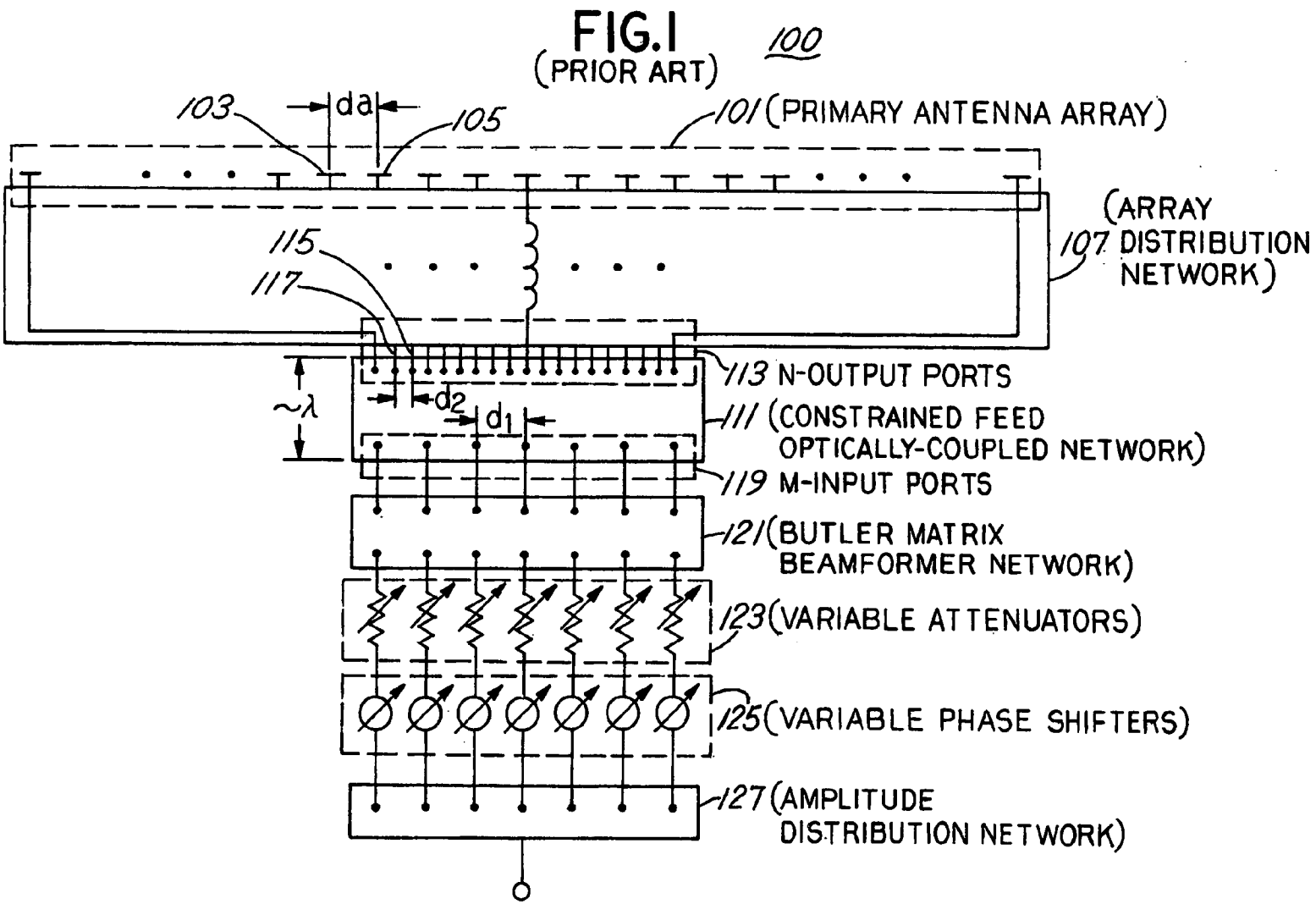
FIG. 1 (PRIOR ART)
FIG. 1 shows a scannable antenna system in accordance with prior art.

FIG. 1 shows scannable antenna system 100 in accordance with prior art as disclosed in U.S. Pat. No. 4,507,662 ("Optically Coupled, Array Antenna", Rothenberg et al.). Scannable antenna system 100 includes a radiating array of antenna elements 101 that radiates (or receives) electromagnetic energy to an intended direction. Radiating array 101 contains N discrete antenna elements (e.g. antenna elements 103 and 105), where each antenna element is coupled, through equal line lengths, to first feed array 113, which is more closely spaced than radiating array 101. First feed array 113 comprises N feed elements (e.g., feed elements 115 and 117). Second feed array 119 is positioned to first feed array in close proximity, typically no more than a wavelength, through optically-coupled network 111. Second feed array 119 comprises M feed elements and has an inter-element spacing that is typically the same as the spacing between adjacent antenna elements. (M is an integer that is less than the integer N.) Second feed array 119 typically spans the same distance as first feed array 113.

Each of the M feed elements of second feed array 119 is coupled to an output port of Butler matrix 121. (Butler matrix 121 may be replaced with another matrix configuration such as a Blass matrix.) Butler matrix 121 also has M input ports, where each input port is coupled to distribution network 127 through variable phase shifter configuration 125 and variable attenuator configuration 123. The corresponding phase shifter and attenuator are adjusted to obtain a desired beam width in a desired direction. However, as second feed array 119 is scanned off boresight to a maximum scan angle of +60/−60 degrees, radiating array 101 scans over a reduced field of field of view, which is determined by the ratio N/M, the spacing between feed elements of first feed array 113, and the spacing between antenna elements of radiating array 101.

A radio source (not shown) provides power to distribution network 127, which distributes the power to variable phase shifter configuration 125. However, antenna system 100 has a reciprocal characteristic so that antenna system 100 can transmit or can receive (but not at the same time). If antenna system 100 is configured to receive, then antenna array 101 receives a radio signal, and distribution network 127 obtains energy from each phase shifter of phase shifter configuration 125 and combines the component powers. The combined power is then processed by a receiver (not shown).

Figure 2:
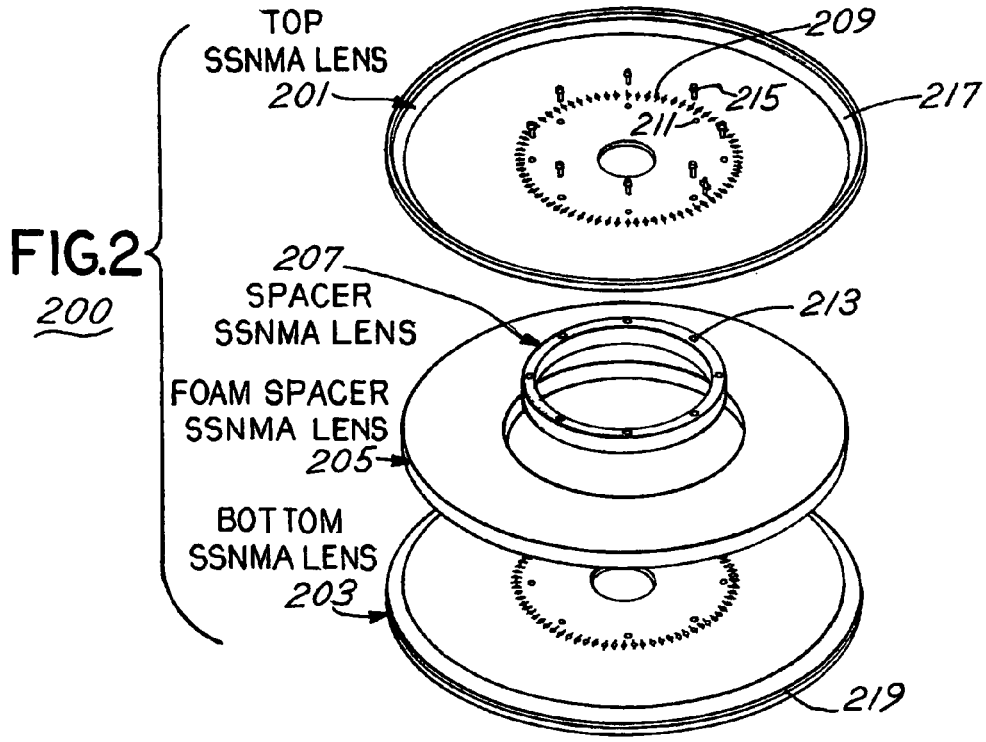
FIG. 2 shows a radial constrained lens in accordance with an embodiment of the invention.

FIG. 2 shows a radial constrained lens 200 in accordance with an embodiment of the invention. Radial constrained lens 200 comprises upper plate 201, lower plate 203, cylindrical insert 207, and foam spacer 205. When assembled together, upper plate 201 and lower plate 203 form a continuous radiating aperture with the combination of upper flange 217 and lower flange 219 functioning as a continuous radiation element. Foam spacer 205 electrically isolates upper plate 201 and lower plate 203 while establishing proper physical separation for desired electrical characteristics. Upper flange 217 and lower flange 219 may assume different shapes including a straight tapered flared section or a curved flared section. With radial constrained lens 200 assembled, upper flange 217 and lower flange 219 function as a radial horn. Also, upper plate 201 and lower plate 203 form a radial waveguide section between feed elements (as will be discussed) and the continuous radiating aperture.

In the embodiment of the invention shown in FIG. 2, flanges 217 and 219 have a homogeneous structure in order to form a continuous radiating aperture. However, other embodiments may comprise a flange having a non-homogeneous structure. For example, a flange may have slots so that discrete radiating elements are formed.

In order to excite the formed continuous radiating aperture, probes are mounted through holes (e.g., hole 209) of plates 201 and 203. Both upper plate 201 and lower plate 203 have a plurality of mounting holes arranged in a circle so that the desired number of probes (each serving as feed elements) may be mounted either in upper plate 201 or lower plate 203, in which each plate can support a set of feed elements. In an alternative embodiment, probes may be mounted through the mounting holes of both upper plate 201 and lower plate 203 in order to form two sets of feed elements as will be discussed later. In the embodiment, a probe is spaced from an adjacent probe in order to sufficiently reduce grating effects. Typically, the probes are spaced between a half wavelength and eight-tenths of a wavelength apart.

In the embodiment shown in FIG. 2, a probe is mounted approximately a quarter wavelength in front of cylindrical insert 207. Cylindrical insert 207 (having a shape of a cylindrical wall) is typically metallic (e.g., aluminum) and functions as an electrical ground surface for each of the probes (e.g., as the probe mounted through hole 209). (Although the embodiment utilizes metallic components, another embodiment may implement a component of radial constrained lens 200 with a non-metallic substance having a deposited layer of metal.) Cylindrical insert 207 also mechanically holds radial constrained lens 200 together with screws (e.g., screw 215) through holes (e.g., 211) in the upper plate 201 and in the lower plate 203 being fitted into threaded holes (e.g., hole 213) of cylindrical insert 207. In a variation of the embodiment, cylindrical insert 207 may be replaced with a disk, in which the outer surface of the disk functions as a ground plane for the probes.

Figure 3:
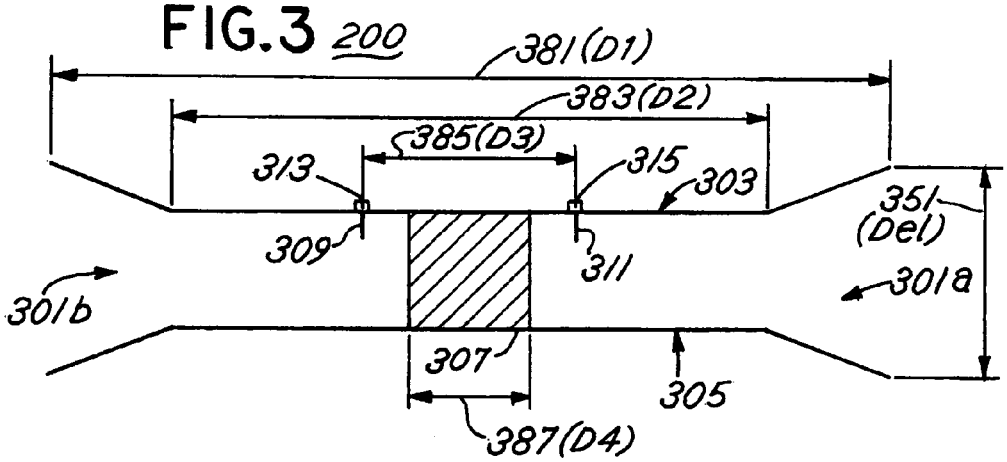
FIG. 3 shows a cross sectional view of a radial constrained lens in accordance with an embodiment of the invention.

FIG. 3 shows a cross sectional view of a radial constrained lens 200 in accordance with an embodiment of the invention. (FIG. 3 is not drawn to scale in order to facilitate describing the embodiment.) Cross section 307 corresponds to cylindrical insert 207, cross section 303 corresponds to upper plate 201, and cross section 305 corresponds to lower plate 203 as shown in FIG. 2. A cross section of the radiating aperture (corresponding to the radiating aperture formed by the flanges 217 and 219) is represented by views 301*a* and 301*b*. The radiating aperture is formed by an apertural structure that comprises flanges 217 and 219 when plates 201 and 203 are assembled together. In the embodiment, the radiating aperture is continuous around the apertural structure.

Probes 309 and 311 are two feed elements of a plurality of feed elements of the feed array. In an exemplary of the embodiment of the invention, as will be discussed, the feed array (excitation array) comprises 36 feed elements, where a portion (sector) of the feed array is activated at a given time. Each probe of the feed array is mounted in a hole (e.g., hole 209) in upper plate 201 or lower plate 203. A radial waveguide section is formed by central portions of plates 201 and 203 between cylindrical insert 207 and the radiating aperture when plates 201 and 203 are fastened together. The radial waveguide section electrically couples the feed array with the radiating aperture.

In the embodiment, probes 309 and 311 are directly coupled to a feed network (as will be discussed) through couplers 313 and 315, respectively. In the embodiment, probes 309 and 311 are coupled to the feed network through coaxial cable with couplers 313 and 315 (e.g., coaxial connectors). Although probes 309 and 311 are shown as vertical conductive segments, variations of the embodiment may implement probes 309 and 311 with a different excitation configuration, e.g., a dipole. Another embodiment of the invention may utilize another excitation configuration, e.g., a magnetic loop.

In the exemplary embodiment shown in FIGS. 2 and 3, upper plate 201 and lower plate 203 may be constructed with aluminum sheeting having a sufficient thickness to provide enough stiffness for mechanical integrity. The embodiment implements plates 201 and 203 with sheeting having a thickness of approximately 0.130 inches thick, although another embodiment may utilize material with a different thickness. Radial constrained lens 200 operates in the C-band corresponding to a frequency range of 3.95–5.85 GHz. As shown in FIG. 3, outside dimension (D1) 381 of plates 201 and 203 is approximately 30.78 inches. Inside dimension (D2) 383 of plates 201 and 203 (which is twice the distance from the center of a plate to its flange) is approximately 28.61 inches. The probes of the feed array are positioned on a circle having a diameter (D3) 385 of approximately 15.8 inches. Cylindrical insert 307 has an outside diameter (D4) 387 of approximately 13.12 inches.

The aperture elevation dimension ($D_{el}$) 351 is shown in FIG. 3 and is used when calculating the directivity of the radiating aperture as will be discussed. In the embodiment, aperture elevation dimension $D_{el}$ 351 is typically a half wavelength or larger to propagate the desired signal.

The operating range of radial constrained lens 200 is limited at low frequencies by the aperture elevation height ($D_{el}$ 351), where the height is approximately a half wavelength. Typically, this consideration limits the low frequency operation to approximately 1 GHz. While it is feasible to dielectrically load the radial waveguide to reduce the physical size at low frequencies, a substantial weight penalty would be incurred.

Figure 4:
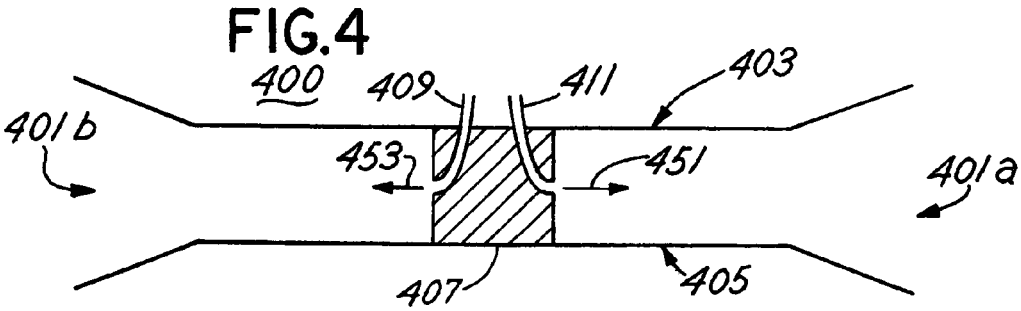
FIG. 4 shows a cross sectional view of a radial constrained lens in accordance with an alternative embodiment of the invention.

At high frequencies, the operating range of radial constrained lens 200 is limited at high frequencies by machining and etching tolerances, Typically, one would expect radial constrained lens 200 to be useful up to the 60–100 GHz range, although it may be necessary to change the feed array to a waveguide launch (corresponding to waveguide sections 409 and 411 as shown in FIG. 4) from a coaxial launch (corresponding to coaxial probes 309 and 311 as shown in FIG. 3).

FIG. 4 shows a cross sectional view of a radial constrained lens 400 in accordance with an alternative embodiment of the invention. Radial constrained lens 400 is similar to radial constrained lens 200. Cross section 407 corresponds to a disk that has a similar electrical function as cylindrical insert 207, cross section 403 corresponds to upper plate 201, and cross section 405 corresponds to lower plate 203 as shown in FIG. 2. A cross section of the radiating aperture is represented by views 401*a* and 401*b*. However, the feed array of radial constrained lens 400 utilizes waveguide sections (e.g., sections 409 and 411) rather than probes 309 and 311. The waveguide sections are coupled to radial constrained lens 400 through holes in a disk (corresponding to cross section 407) so that power, as depicted by 453 and 451, can be transferred to radial lens 400.

Figure 5:
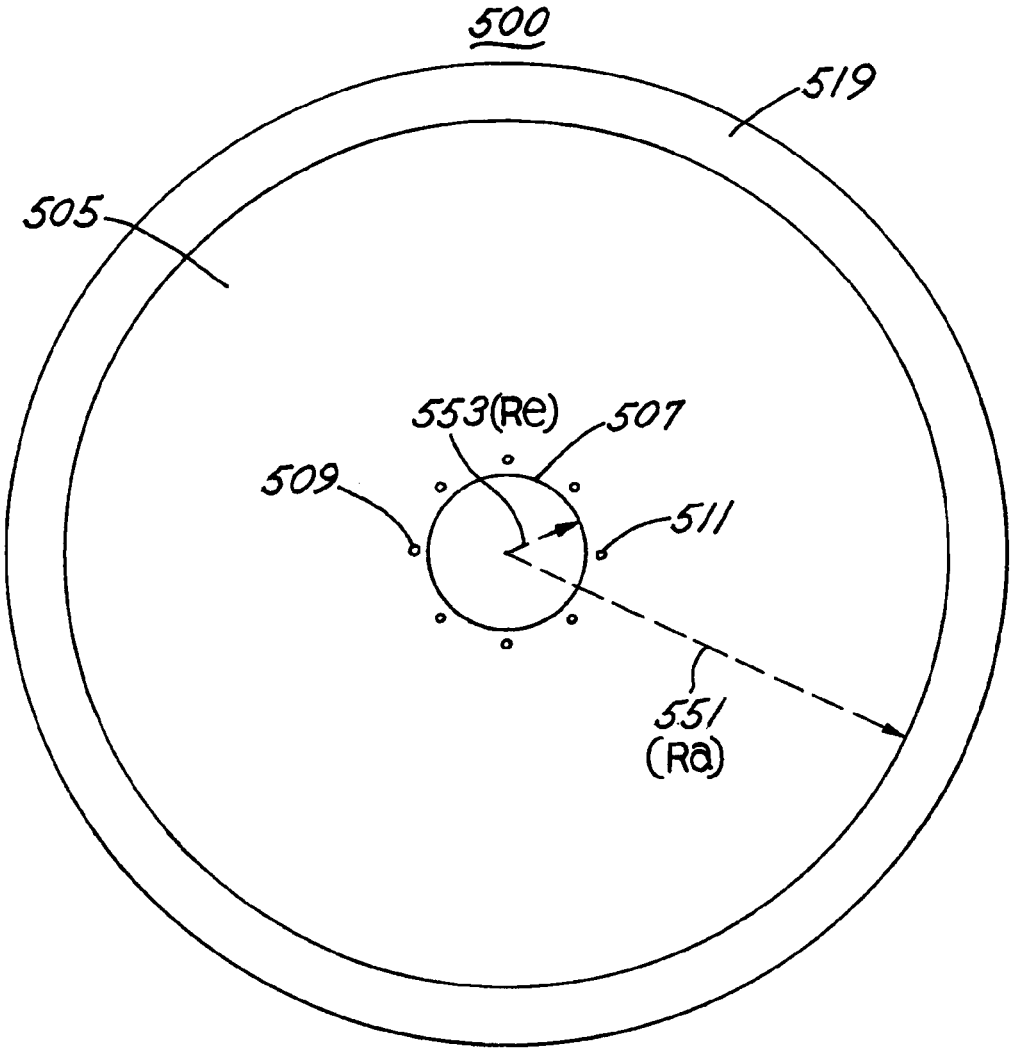
FIG. 5 shows a top view of the radial constrained lens that is shown in FIG. 3.

FIG. 5 shows a top view of the radial constrained lens 500 that corresponds to the cross sectional view as shown in FIG. 3. Probes 509 and 511 correspond to probes 309 and 311 as shown in FIG. 3. In the embodiment, the feed array includes eight probes, although the embodiment can support a different number of probes (e.g., thirty six elements for an exemplary embodiment that will be discussed) in order to support different electrical characteristics. The feed array is coupled to the radiating aperture 519 (corresponding to 301*a* and 301*b* in FIG. 3) through radial waveguide 505, which couples probes 509 and 511 to radiating aperture 519. The radius of feed array is $R_e$ 553 and the radius of radiating aperture is $R_a$ 551.

Figure 6:
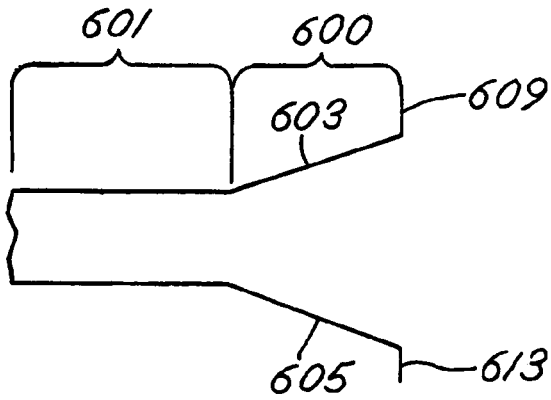
FIG. 6 shows a cross sectional view of an apertural structure having a continuous aperture in accordance with an embodiment of the invention.

FIG. 6 shows a cross sectional view of apertural structure 600 having a continuous aperture in accordance with an embodiment of the invention. In the description herein, an apertural structure includes at least two flared portions and specifies an associated aperture. Apertural structure 600 comprises upper flared portion 603, upper lip portion 609, lower flared portion 605, and lower lip portion 613. (Upper flared portion 603 and upper lip portion 609 correspond to flange 217. Lower flared portion 605 and lower lip portion 613 correspond to flange 219 as shown in FIG. 2.) In the embodiment, the distance between the upper plate and the lower plate is approximately 1.35 inches and lip portions 609 and 613 are 0.5 inches. The flange angle (corresponding to the taper of flared portions 603 and 605) controls the elevation beamwidth. In an exemplary embodiment, the flange angle is approximately 35 degrees.

Figure 7:
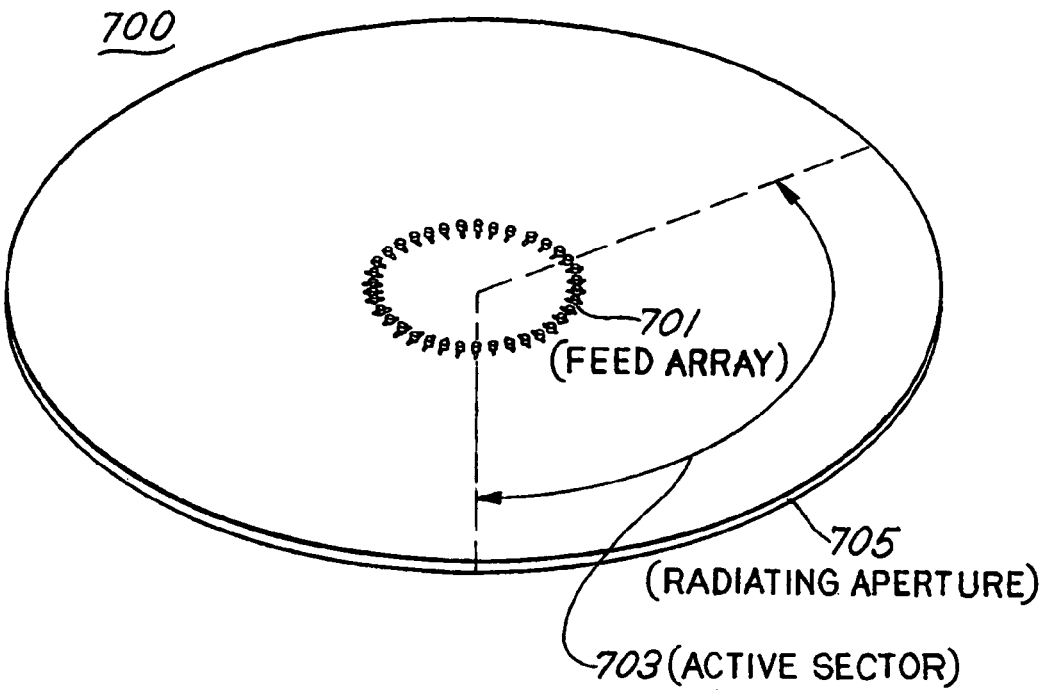
FIG. 7 shows a radial constrained lens in accordance with an embodiment of the invention.

FIG. 7 shows a radial constrained lens 700 in accordance with an embodiment of the invention. Feed array 701 comprises thirty six feed elements. In the embodiment, a subset of the feed elements is active at a given time in order to reduce the complexity of the feed network circuitry that excites the feed elements. Each active feed element is excited with a corresponding processed signal, in which both the amplitude and phase is adjusted by the feed network circuitry as will be discussed in the context of FIG. 9. In the exemplary embodiment shown in FIG. 7, approximately one third of the feed elements are excited at a given time, corresponding to 120-degree sector 703. However, the embodiment can support different sector angles, e.g., a 90-degree sector, in which approximately one quarter of the feed elements is active.

Radial constrained lens 700 provides scan coverage over a full 360-degree azimuth field by selecting a subset of adjacent feed elements to form a sector. Radial constrained lens 700 is scanned over small angles with the scanning range of the selected sectors. Feed array 701 may be commutated by selecting another sector of feed array 701. (In the embodiment, a selected sector may overlap another sector by different amounts.)

The probes of feed array 701 form a fully overlapped subarray structure at radiating aperture 705. Hence, a small amount of change in the feed (excitation) array scan angle produces a larger scan angle excursion at the radiating aperture 705. The scan relationship between feed array 701 and aperture array 705 is given as:

$$\sin\theta_a = R_a/R_e * \sin\theta_e \quad \text{(EQ.1)}$$

where $\theta_a$ is the aperture scan angle, $\theta_e$ is the excitation scan angle, $R_a$ is the aperture radius, and $R_e$ is the feed array radius. Because a radiating aperture (e.g., radiating aperture 705) typically commutates over large angles and scans over small angles, Equation 1 may be approximated by:

$$\theta_a \approx R_a/R_e * \theta_e \quad \text{(EQ.2)}$$

Figure 9:
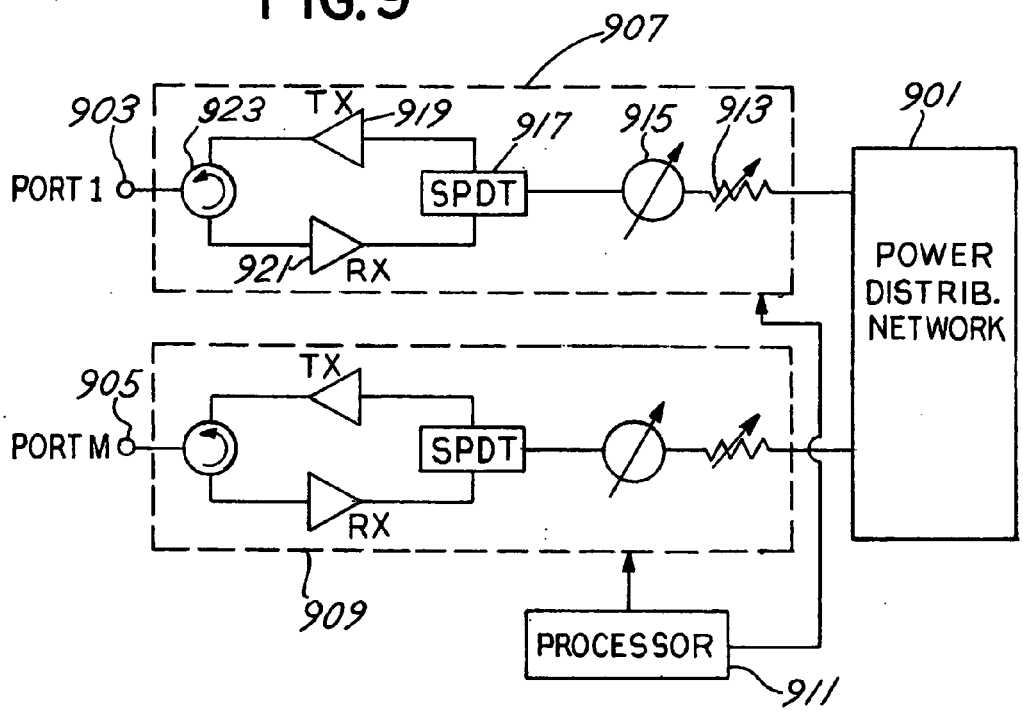
FIG. 9 shows a feed network to a radial constrained lens in accordance with an embodiment of the invention.

Moreover, radial constrained lens 700 may be commutated about a full aperture field of view (i.e., a 360-degree azimuth angle) as illustrated in FIG. 9. A subset of adjacent feed elements may be selected to form a sector. Additionally, each active feed element is provided a signal with appropriate phase and amplitude characteristics. (A feed network performs corresponding signal processing as will be discussed.)

The directivity of radiating aperture 705 may be estimated by:

$$\text{Directivity}(\text{dB}i) = 10*\log(4\pi A/\lambda^2) \quad \text{(EQ.3)}$$

where A is the projected area of radiating aperture 705 and $\lambda$ is the operating wavelength. Equation 3 may be rewritten as:

$$\text{Directivity}(\text{dB}i) = 10*\log(4\pi D_{az} D_{el}/\lambda^2) \quad \text{(EQ.4)}$$

where $D_{az}$ is the projected azimuth aperture dimension (as will be discussed in the context of FIG. 8) and $D_{el}$ is the aperture elevation dimension (as shown in FIG. 3 as $D_{el}$ 351).

Figure 7A:
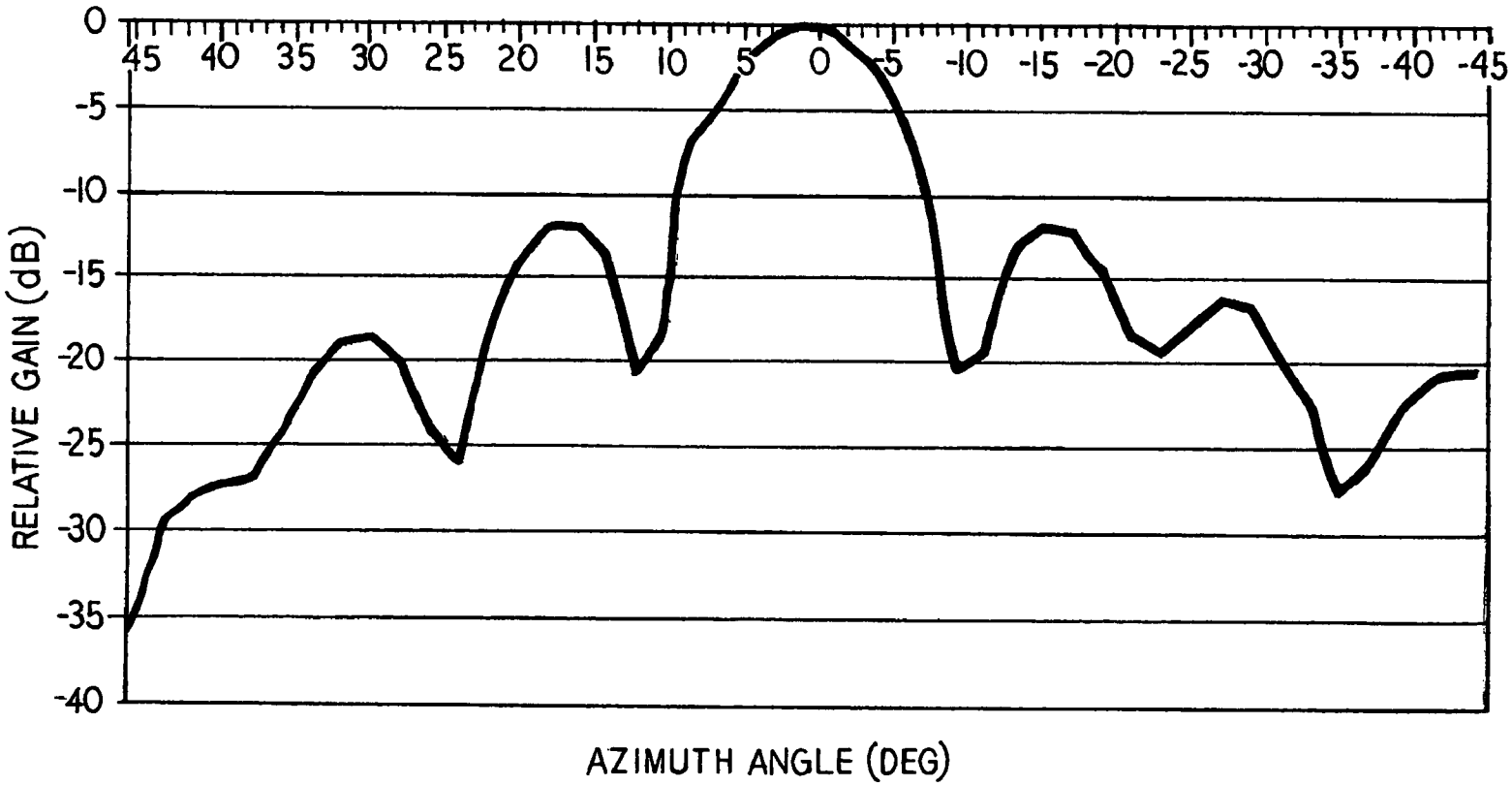
FIG. 7A shows experimental data of an azimuthal antenna pattern corresponding to an exemplary embodiment of the radial constrained lens shown in FIG. 7.

FIG. 7A shows experimental data of an azimuthal antenna pattern 751 corresponding to an exemplary embodiment of radial constrained lens 700. The main lobe has an azimuth angle of approximately 20 degrees.

Figure 8:
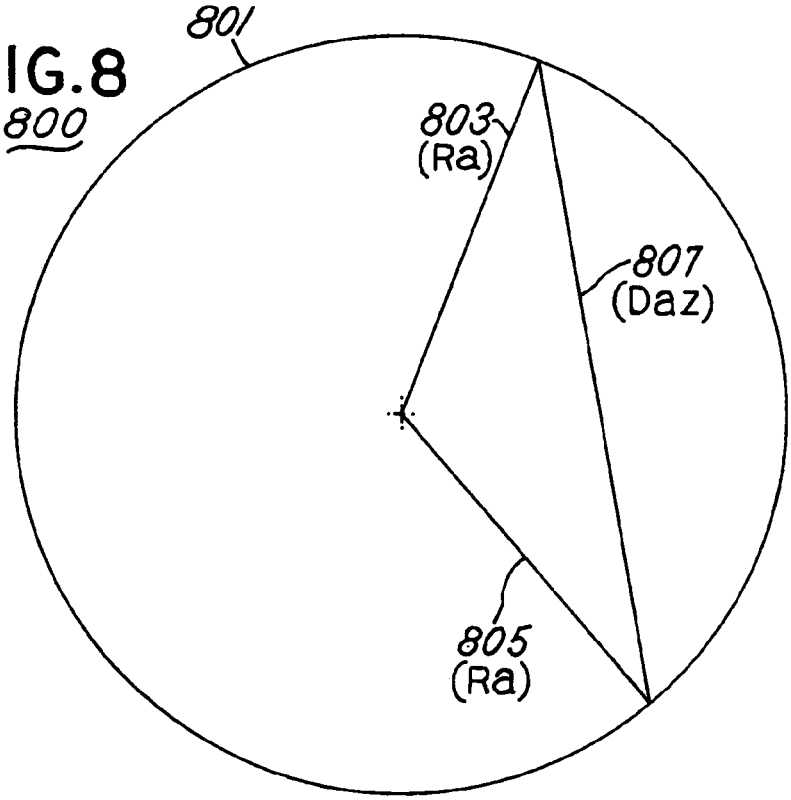
FIG. 8 shows a top view of a radial constrained lens in accordance with an embodiment of the invention.

FIG. 8 shows a top view of radial constrained lens 800 in accordance with an embodiment of the invention. Boundary 801 outlines the dimensions of radiating aperture 705. Sector 703 corresponds to an angle between radii ($R_a$) 803 and 805. (Exemplary sectors include 90-degree sectors and 120-degree sectors, although the embodiment may support sectors with different angular spreads.) Projected azimuth aperture dimension $D_{az}$ corresponds to a length of a line that connects the intersecting points on boundary 801 and radii 803 and 805. From the geometry modeled in FIG. 8, one can approximate the directivity of aperture that is excited by a 90-degree sector and a 120-degree sector from Equation 4, where $D_{az}$ equals 1.414 $R_a$ and 1.732 $R_a$, respectively.

FIG. 9 shows a feed network 900 for a radial constrained lens in accordance with an embodiment of the invention. The embodiment supports M ports, in which each port (e.g., port 903 and port 905) is coupled to a feed element. Circuit module 907 provides the excitation for port 903 by modifying the phase and amplitude characteristics of an excitation signal provided by power distribution network 901. Circuit module 909 provides the excitation to port 905. Circuit module 907 comprises attenuator 913, phase shifter 915, switch 917, transmit buffer 919, receive buffer 921 and circulator 923.

The excitation signal from power distribution network 901 is attenuated (to adjust the amplitude) by attenuator 913 and phase shifted by phase shifter 915. (An approach for determining the induced phase shift is discussed in the context of FIG. 10.) With the embodiment of the invention, a radial constrained lens (e.g., radial constrained lens 200) may support either a transmitting configuration or a receiving configuration by appropriately configuring switch 917. When in a transmitting configuration, power distribution network 901 provides an excitation signal through attenuator 913, phase shifter 915, switch 917, transmit buffer 919, and circulator 921 to port 903. When in a receiving configuration, receiving apparatus (not shown and that replaces power distribution network 901) receives a received signal from port 903 through circulator 923, receive buffer 921, switch 917, phase shifter 915, and attenuator 913. The receiving apparatus combines received signals from the M ports.

The embodiment shown in FIG. 9 may support different sector configurations. For example, while switch 917 is shown as a SPDT switch, switch 917 maybe a SP3T switch to support a 120-degree sector and a SP4T switch to support a 90-degree sector.

In the embodiment, processor 911 adjusts the phase shifter (e.g., 915), the attenuator (e.g., 913), and switch (e.g., 917) of each circuit module in order to form a beam pattern in the desired direction for either the transmit mode or the receive mode. Processor 911 may receive an input from an input device (not shown) that instructs processor 911 to form the beam pattern or may automatically steer the beam pattern according to a steering algorithm.

Feed network 900 may be configured to form a selected sector and to form a beam pattern within the selected sector by configuring the attenuators and phase shifters of feed network 1000. Thus, by appropriately configuring feed network 900, a radial constrained lens may form a beam pattern so that the scanning coverage in the azimuthal direction is approximately 360 degrees.

Referring to FIG. 2, the embodiment of the invention may support two sets of feed elements (each set forming a feed array). A first set of feed elements is mounted to upper plate 201 and a second set of feed elements is mounted to lower plate 203. Each feed element is directly coupled to a corresponding circuit module so that each set of feed elements forms an independent radiation beam pattern in conjunction with continuous radiating aperture (formed by flanges 217 and 219).

Figure 10:
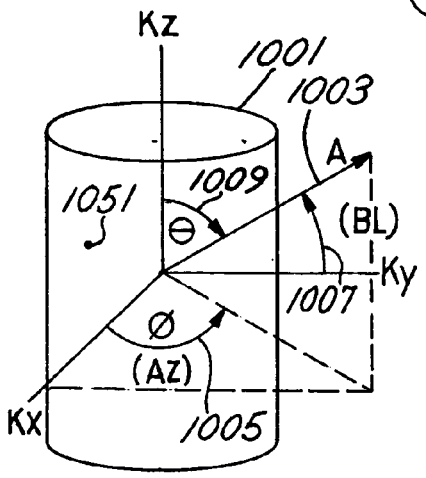
FIG. 10 shows a cylindrical array geometry in accordance with an embodiment of the invention.

FIG. 10 shows a cylindrical array geometry in accordance with an embodiment of the invention. The cylindrical array geometry represents a cylindrical aperture, in which a radiating element is located in the cylindrical surface at the point 1051 ($X_e$,$Y_e$,$Z_e$). Vector $\vec{A}$ 1003 describes the pointing angle of the antenna's mainbeam, where the boresight is along the $K_x$ axis. Angle (AZ) 1005 is equal to cylindrical coordinate $\phi$. Cylindrical coordinate $\theta$ is equal to 90 minus EL (degrees). The distance from any radiating element to a planar phase front is given by:

$$d=X_e \sin\theta \cos\phi+Y_e \sin\theta \sin\phi+Z_e \cos\theta \quad \text{(EQ.5)}$$

The distance d can be related to the phase length l by:

$$l=2\pi/\lambda*d \quad \text{(EQ.6)}$$

From Equations 5 and 6, one can determine the phase length from any radiating element to a planar phase front by:

$$l=2\pi/\lambda(X_e \cos EL \cos AZ+Y_e \cos EL \sin AZ+Z_e \sin EL) \quad \text{(EQ.7)}$$

From Equation 7, one can determine the configuration of circuit module 907 so that the phase length between the radiating element and the planar phase front is compensated by the amount of phase shift provided by a corresponding phase shifter (e.g., phase shifter 915). Calculations can be repeated for the other radiating elements. With the receive mode one typically uses a "cosine-squared-on-a-pedestal" amplitude taper for cylindrical apertures in order to reduce the receive sidelobe level. With the transmit mode, one typically uses a uniform illumination in order to maximize transmit gain.

While radial constrained lens 700 supports beam scanning in an azimuthal direction, a plurality of radial constrained lens may be vertically stacked in order to scan a formed beam in both the desired azimuthal direction and the desired elevation direction. One can use the beam steering equation given in Equation 7 to determine the required phase adjustments needed for each feed element of the constituent radial constrained lens.

Figure 11:
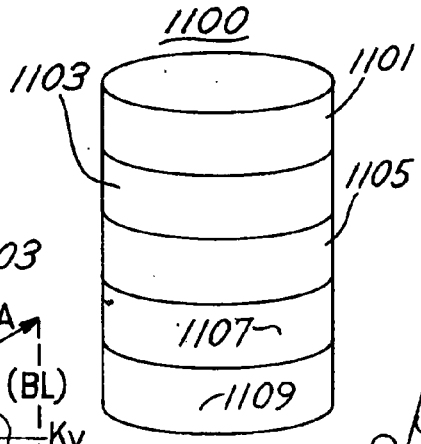
FIG. 11 shows a stacked configuration comprising a plurality of radial constrained lens and having a cylindrical aperture in accordance with an embodiment of the invention.

FIG. 11 shows a cross sectional view of stacked configuration 1100 comprising radial constrained lens 1101, 1103, 1105, 1107, and 1109 and having a cylindrical aperture in accordance with an embodiment of the invention. In the embodiment, each of the radial constrained lens is similar to radial constrained lens 200 as shown in FIG. 200. The feed elements of each radial constrained lens are excited by a feed network (not shown and having a similar structure as feed network 900 as shown in FIG. 9). Each of the constituent radial constrained lens has a continuous radiating aperture. Consequently, by stacking radial constrained lens 1101, 1103, 1105, 1107, and 1109, the stacked radiating aperture forms a cylindrical aperture.

Figure 12:
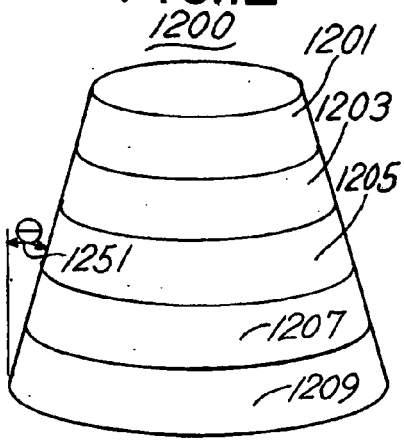
FIG. 12 shows a stacked configuration comprising a plurality of radial constrained lens and having a conical aperture in accordance with an embodiment of the invention.

FIG. 12 shows a cross sectional view of stacked configuration 1200 comprising radial constrained lens 1201, 1203, 1205, 1207, and 1209 and having a conical aperture in accordance with an embodiment of the invention. In the embodiment, each of the radial constrained lens is similar to radial constrained 200 with each successive radial constrained lens having a larger radius. In the embodiment, aperture angle 1251 is approximately 14 degrees.

Table 1 shows an exemplary comparison between a Ku antenna design using a conventional antenna and using a radial constrained lens that is designed for aircraft installations. (The Ku-band corresponds to a frequency range of 12.5–14 GHz.) In the example, a radial constrained lens provides approximately the same effective isotropic radiate power with half the prime power (350 W vs. 700 W) and with half the number of feed elements (36 vs. 72) as with a conventional design. These differences translate to a reduced overall weight with the radial lens antenna. Moreover, the radial constrained lens design provides a mechanism for eliminating the electronics chassis and the RF connections between the aperture and the chassis.

TABLE 1

IMPACT OF RADIAL LENS ON KU-BAND ANTENNA DESIGN

| Parameter | Conventional Antenna | Radial Lens Antenna |
|---|---|---|
| Overall Weight | 100 lb. | 60 lb. |
| Prime Power Required | 700 W at 28 VDC | 350 W at 28 VDC |
| Aperture Size | 12 in. diameter by 5 in. high | 24 in. diameter by 5 in. high |
| Number of Feed Elements | 72 | 36 |
| Number of Active Feed Elements | 24 | 12 |
| Azimuth Beamwidth | 5 degrees | 2.5 degrees |
| Elevation Beamwidth | 25 degrees | 25 degrees |
| Antenna Gain | 24.8 dBi | 27.8 dBi |
| Combined RF Power | 96 W | 48 W |
| Effective Isotropic Radiated Power (EIRP) | 40 dBW | 40 dBW |

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, microcontroller, digital signal processor, and associated peripheral electronic circuitry.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

I claim:

1. An antenna system that forms a directional beam radiation pattern, comprising:

an upper metallic plate that has a first flange, the first flange functioning as an upper portion of a continuous radiating aperture;

a lower metallic plate that has a second flange, the second flange functioning as a lower portion of the continuous radiating aperture;

a ground plane that comprises a circular metallic structure, the ground plane being approximately symmetrically located at a center of a radial constrained lens, the radial constrained lens formed by the upper metallic plate and the lower metallic plate;

at least one feed array comprising a plurality of feed elements, the plurality of feed elements being physically coupled to at least one of the plates; and a spacer that electrically isolates the upper plate and the lower plate so that a central portion of the upper plate and the lower plate form a section of radial waveguide, the section of radial waveguide coupling electromagnetic energy between the at least one feed array and the continuous radiating aperture.

2. The antenna system of claim 1, further comprising:

a feed network that is coupled to one of the plurality of feed elements to provide a signal to the feed element, a phase characteristic and an amplitude characteristic of the signal being determined by a circuit module of the feed network.

3. The antenna system of claim 2, wherein the circuit module of the feed network comprises:

a phase shifter that affects the phase characteristic of the signal; and an attenuator that affects the amplitude characteristic of the signal.

4. The antenna system of claim 2, wherein the feed network comprises:

a switch that configures the circuit module to either receive or transmit a radio signal.

5. The antenna system of claim 4, wherein the switch configures the circuit module to activate a selected feed element that is associated with a selected sector.

6. The antenna system of claim 1, wherein the first flange comprises a first flared portion and first lip portion, and wherein the second flange comprises a second flared portion and a second lip portion.

7. The antenna system of claim 6, wherein the first flared portion and the second flared portion are tapered at approximately 35 degrees.

8. The antenna system of claim 2, wherein the feed network is directly coupled to the feed element.

9. The antenna system of claim 1, wherein the plurality of feed elements comprises a plurality of probes.

10. The antenna system of claim 1, wherein the plurality of feed elements comprises a plurality of waveguide sections.

* * * * *